United States Patent [19]

Wieser

[11] 4,143,771

[45] Mar. 13, 1979

[54] DEVICE FOR REMOVING A SELECTED BOX FROM A SUCCESSION OF MOVING BOXES

[75] Inventor: Louis Wieser, Ecublens, Switzerland

[73] Assignee: J. Bobst & Fils, S.A., Switzerland

[21] Appl. No.: 774,035

[22] Filed: Mar. 3, 1977

[30] Foreign Application Priority Data

Mar. 8, 1976 [CH] Switzerland ..... 002851/76

[51] Int. Cl.[2] ..... B07C 5/344

[52] U.S. Cl. ..... 209/583; 209/657; 198/605; 198/442; 271/64

[58] Field of Search ..... 209/73, 74, 75, 111.7 R, 209/111.7 T, 111.8; 198/605, 367, 597, 599, 442; 271/64

[56] References Cited

U.S. PATENT DOCUMENTS

| | | | |
|---|---|---|---|
| 2,728,466 | 12/1955 | Postlewaite | 198/367 |
| 3,782,543 | 1/1974 | Martelli | 209/75 |
| 3,987,902 | 10/1976 | Burgess et al. | 209/75 |

*Primary Examiner*—Allen N. Knowles

*Attorney, Agent, or Firm*—Hill, Gross, Simpson, Van Santen, Steadman, Chiara & Simpson

[57] ABSTRACT

An apparatus for withdrawing a predetermined box from a flow of folded boxes traveling in a plane in a device, such as a box folding and gluing machine, which has conveyors for moving the folded boxes in the plane characterized by a detector for detecting an undesired or damaged box, a deflector mounted for reciprocal movement adjacent a discharge of the conveyor for deflecting the damaged or undesirable box out of the plane of the flow of boxes and a conveyor for conveying the deflected box away from the flow of boxes.

7 Claims, 3 Drawing Figures

DEVICE FOR REMOVING A SELECTED BOX FROM A SUCCESSION OF MOVING BOXES

BACKGROUND OF THE INVENTION

1. Field of the Invention

The present invention is directed to an apparatus for withdrawing a predetermined or selected box from a flow of folded boxes traveling in a plane in a device.

2. Prior Art

In a box folding and gluing machine, the box blanks being processed into folded boxes generally belong to one and the same batch. However, on account of handling errors, there is a possibility that box blanks of identical shape and size but with different printing might be either added to or mixed with the box blanks of the batch being processed by the folding and gluing machine. An example of the problem, which will occur from such an error, is that for instance a given batch of box blanks, which are to be folded and glued into folded boxes, might have printing in French and contain blanks having the printing in English, German or some other language. Thus, the whole batch of folded and glued boxes must be sorted before being sent to the customer to ensure that they all contain the printing in the correct language. Since sorting is a manual process, it takes a lot of time and is expensive.

Another problem that occurs in box folding and gluing machines is ensuring that each box is actually glued. Experience has shown that insufficient gluing of the box may be either due to inadequate application of the glue by the gluing unit of the machine or due to the box having a damaged or torn off glue flap so that the box is not provided with the necessary glue and is therefore not usable. In order to spot insufficiently glued boxes after they travel through a box folding and gluing device, it is necessary to sort the boxes, which are collected at the machine's outlet.

To solve the above mentioned problems and to avoid sorting, various solutions have already been proposed. One of these solutions consist in providing the box blanks with a code corresponding to the information printed thereon and this code will indicate the type of lettering, color and graphic display on the box. By scanning this code and comparing it with the code for the particular box blank that is to be utilized, a blank or box having either the wrong color, graphic representation, or lettering can be rejected.

One of the devices which has been proposed for rejecting and undesired box utilizes a rotating disk operating jointly with an intermittenly actuated pressure roll. In the box folding and gluing machine, this device is located at an outlet of a section which is equipped with means for accelerating and ejecting folded and glued boxes and, therefore, is immediately before the device which counts the boxes. In this particular section, the folded boxes are carried between a lower and upper continuous belt conveyor. The device for ejecting the undesired box box is situated outside of the lower conveyor with the upper plane of the rotating disk coinciding with the plane formed by the lower side of the folded and glued box being transported on the conveyors. The pressure roll is positioned obliquely with regard to the direction of travel of the boxes so that when it is actuated, it will engage the undesired box and cause it to move sideways relative to the flow of boxes in the conveyor.

The operation of this device has certain inconveniences, for example, it compels the operator of the machine to pull the undesired box sideways from between the bells of the upper and lower conveyors. Thus, it will be necessary to release the pressure applied by the belts of the conveyor in the area where the undesired box is to be rejected. The lack of pressure on the boxes provides certain handicaps such as causing the conveyance of the boxes to be less reliable and interferring with the counting of the box blanks. In folding and gluing apparatuses, the boxes are counted up to the nth box, which is shifted sidewise in the conveyor. The sidewise shifting of the nth box is obtained by kicking or striking an edge of the nth box so that it will be knocked against a target or stop, which is situated on an opposite side of the conveyor to the kicking or striking device. If the box is held positively between the belts of the upper and lower conveyors, its sidewise shift will correspond practically to the distance existing between the box edge before the shift and the target. However, if on the other hand, the box is not held properly, for example the upper conveyor applies an insufficient pressure on the box, the box will rebound from the target or stop and in the worst case, the box counted and kicked will practically return to its former position. In such an instance, it is almost impossible to distinguish at the outlet of the machine which box actually represents the nth box.

Another difficulty is that if a large size box is to be rejected, the pulling out of the box from between the belts of the upper and lower conveyor will possibly cause the belts to be driven or pulled off of their respective pulleys or belt sheaves.

SUMMARY OF THE INVENTION

The present invention is directed to an apparatus for withdrawing a predetermined or selected box from a flow of folded boxes, which apparatus overcomes the drawbacks of the prior art apparatuses and, therefore, increases productivity of a box folding and gluing machine.

To accomplish this task, the apparatus for withdrawing the predetermined or selected box from a flow of folded boxes traveling in a plane in a device having means for conveying the folded boxes in said plane, said apparatus comprises means for detecting the selected box, means for selectivety deflecting the selected box from the plane of the flow of boxes, said means for deflecting being disposed adjacent a discharge of the means for conveying and including means for moving the deflecting means relative to the plane of the flow of boxes between a position withdrawn from the flow of boxes to a deflecting position in response to a signal from the means for detecting, and means for ensuring the positive conveyance of the selected box deflected from the plane of the flow, said means for ensuring the conveyance being disposed adjacent said discharge so that the box selected by the means for detecting is deflected from the plane of the flow of the boxes and is conveyed away from said deflecting means and the flow of boxes.

In the preferred embodiments, the means for moving comprises an air actuated piston having a piston rod and the means for deflecting includes a blade disposed on the piston rod and preferably at an oblique angle. The piston and piston rod are located so that the blade is reciprocated in a vertical direction relative to the plane of the flow of boxes. The means for ensuring conveyance of the deflected box consists of a belt conveyor which is adapted to coact with a portion of a return run of a continuous belt conveyor of the means for conveying the boxes in a flow.

DESCRIPTION OF THE PREFERRED EMBODIMENTS

Figure 1:
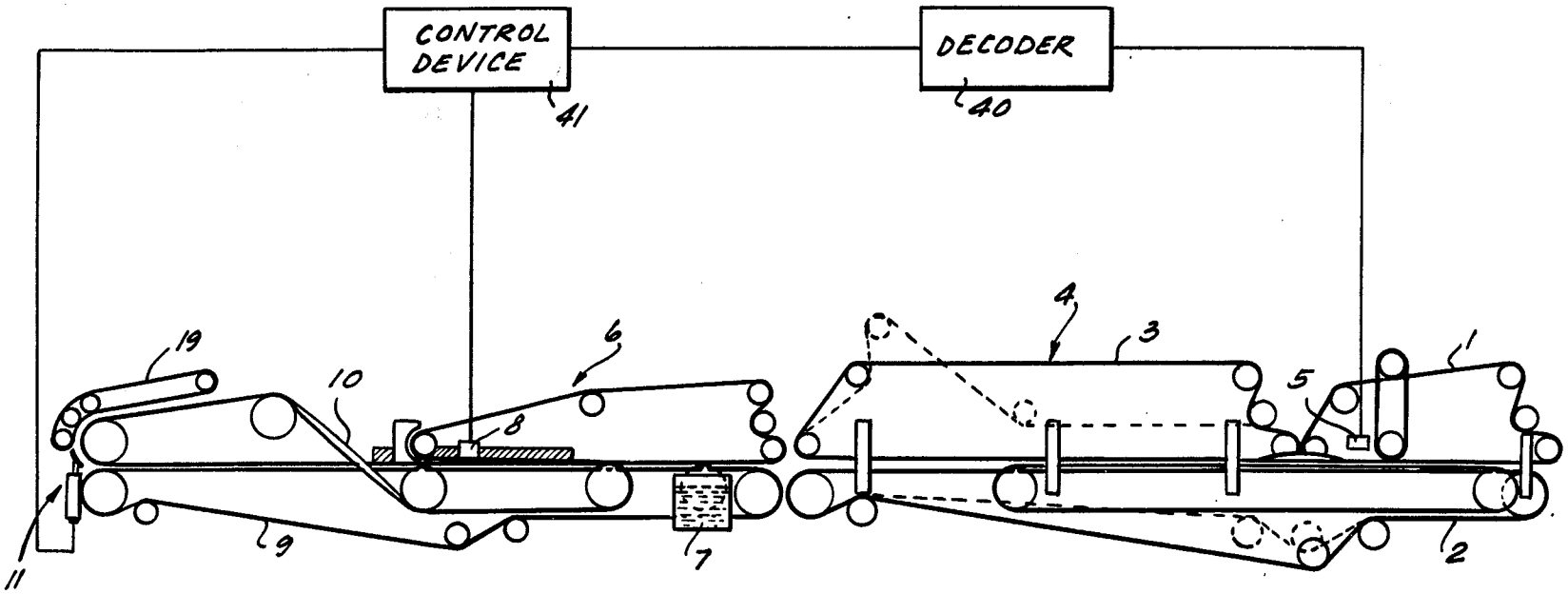
FIG. 1 is a generaly schematic view of a box conveying device having the apparatus in accordance with the present invention.

The principles of the present invention are particularly useful in a box blank conveying mechanism schematically illustrated in FIG. 1 which is used in a box folding and gluing machine or device which is illustrated as having a section generally indicated at 4 and a section generally indicated at 6.

The section 4 is generally known as "prebreaking track" and consists of conveyors 1, 2 and 3 for transporting or conveying a box blank, which has been fed into the machine by a conventional feeding mechanism (not illustrated) to a point for discharge into section 6. As the box blank travels through section 4, it is manipulated in a conventional manner to cause prebreaking of the first and third folds of the blank. The prebreaking involves folding the blank through approximately 90° at these folds and then opening the folds again to produce a flat blank. Immediately after the area where the glue flap, which corresponds to the first fold, has been folded to 90°, a photoelectric cell 5 acts as detecting means and scans a code printed on the flap. The information gathered by the detecting means 5 is transmitted to a decorder 40. If the detected code does not correspond to the desired code, the decoder will emit an impulse or signal to a control device 41 for a box deflecting means 11 so that a blade 17 (FIG. 2) will move at a given moment into the plane of the flow of boxes to ensure that the selected box is rejected from the flow.

After a box blank has passed the detecting means 5 and is discharged from section 4, it is introduced into section 6, which is generally known as a "folding track." At the inlet of the section 6, a glue flap of the box blank has glue applied by a gluing unit 7. After gluing, the box blank will then be manipulated to fold it along the second and third folds by means of a conventional mechanism consisting of taper rollers acting jointly with a belt 10. In order to check whether the glue line has been properly applied on the glue flap of the box blank, a second detecting means 8, comprising a photocell, is arranged on the track to check the glue flap. The photocell 8 is situated in an area corresponding to the area where the glued panel or flap is put upright to about 90° with regard to the plane formed by the upper run of a lower conveyor belt 9 of section 6. The box deflecting means 11 is situated at the outlet or discharge of section 6 and is aligned with the conveyors of the section. It should be noted that the detecting means 8 will create a signal if the glue flap has been either damaged such as being torn or if the glue line has been improperly applied on the flap. The signal can be received by the control device 41 so that the deflecting means 11 can be actuated in response to detection of either an undesired blank having the wrong code by the detecting means 5 or a blank having an improperly applied glue line by detecting means 8. For purposes of this invention, the term "selected box" refers to a box formed from a blank having either an improper coding or an improper glue flap.

Figure 2:
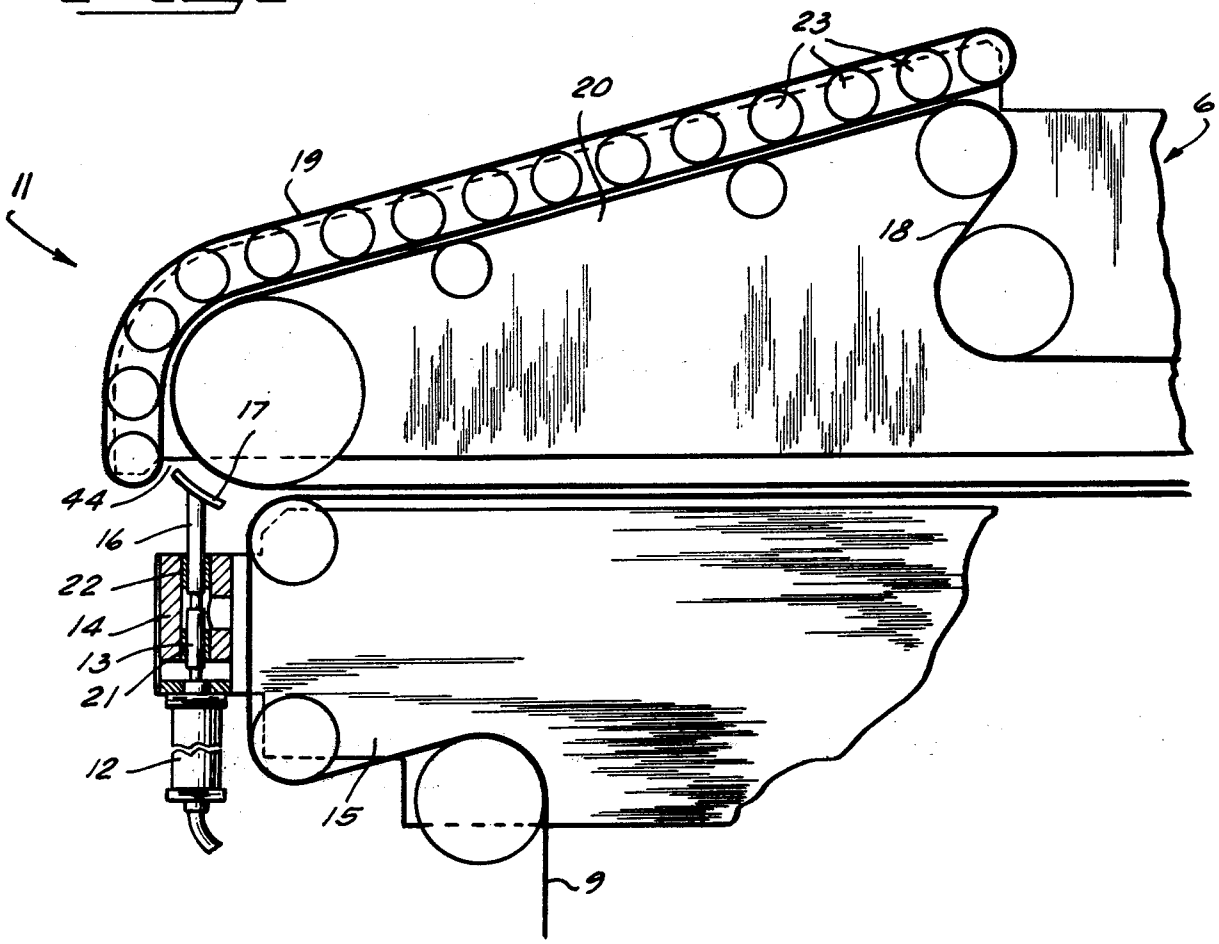
FIG. 2 is an enlarged schematic view of one end of the box conveying mechanism equipped in accordance with the present invention.
Figure 3:
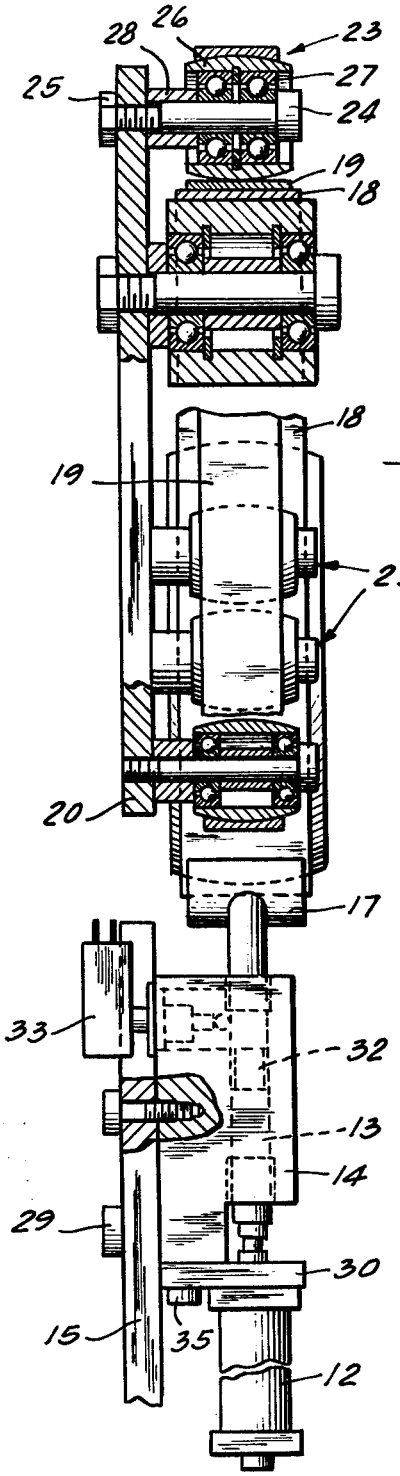
FIG. 3 is an end view taken from direction of arrow A in FIG. 2 with portions in cross section for purposes of illustration.

The operation of the means 11 for deflecting the selected box are best illustrated in FIGS. 2 and 3. As illustrated, the means 11 for deflecting a box includes means for shifting the blade 17 between a withdrawn position and a deflecting position relative to the plane of the flow of boxes, which plane is defined by the lower endless conveyor belt 9 and an upper endless conveyor belt 18 of section 6. As illustrated, the deflecting blade 17 is shifted vertically from a withdrawn position (not illustrated) to the deflecting position, which will cause an upward deflection of a folded and glued box from the plane of the flow of boxes.

As illustrated in FIGS. 2 and 3, the means for moving includes an air control piston 12 having a piston and rod 13 with an end 16 which mounts the blade 17 at approximately 45° to the axis of the piston rod. The means for moving is mounted on a side frame 15 of the endless conveyor 9 by a support 14 which is attached to the side frame 15 by screws 29 (FIG. 3). The support 14 receives a pair of self-lubricating bushings 21 and 22 which guide the piston rod 13 for reciprocal movement. The air actuated cylinder 12 is fitted on a fastening flange 30 (FIG. 3), which is attached or fastened to the support 14 by means of screws 31. The piston rod 13 has an annular recess 32, which receives a contact of a switch 33 to indicate the actual axial position of the rod 13 and, therefore, the deflecting blade 17.

To facilitate removal of a box which has been deflected upwardly by the blade 17, means for ensuring conveyance comprising an endless conveyor belt 19 is aligned with the outlet or discharge end of conveyors 9 and 18 of the box conveying means of section 6. As illustrated, the conveyor 19 has a configuration which closely conforms to a portion of the return run of the upper conveyor 18 and coacts therewith to form an inlet 44 for receiving a deflected box and for conveying it away from the deflector plate 17 and the flow of boxes in the conveyors 9 and 18. As best illustrated in FIG. 3, the conveyor 19 is mounted on a side frame member 20 of the conveyor 18. This is accomplished by rollers 23 of the belt conveyor 19 being mounted on the side frame member 20 of the upper conveyor 18 by means of screws such as 24 and nuts 25 (FIG. 3). Each of the rollers 23 consist of a hollow tube 26, which is supported on the screw 24 by a pair of roller bearings 27 and is positioned from the frame member 20 by a spacing bushing 28 which is also telescopically received on each of the screws 24.

Operation of the device is as follows. The detecting means 5 senses a code of each box blank being passed along section 4 of the device. The sensed code is sent to a decoder 40, which compares the code with the code of the desired box being processed. In the event that the sensed code is incorrect, a pulse or signal is sent to a control 41, which will cause actuation of the piston 12 to raise the deflector plate 17 from a withdrawn position to a position blocking passage of the flow of boxes being conveyed by the endless belts 9 and 18. In a similar manner, if after application of glue by the glue applier 7, the detecting means 8 detects an improperly applied glue line or a damaged glue flap, a signal is sent to the control 41, which will again actuate the deflecting means by raising the blade 17 into the path of the box. The switch 33, enables the detection of the position of the blade 17, for example the raised or deflecting position. After the undesirable box, which either has the wrong code or a deflective glue flap has been deflected into the inlet 44, it is positively conveyed or transported away from the flow by means of the coaction of the conveyors 19 and 18. Subsequently, the blade 17 of the deflecting means 11 is retracted to allow the next box to be passed through the device.

The present invention ensures the removal of a wrong or damaged box in an efficient way without interferring with the production performance. For example, the present invention will enable the removal of a damaged or undesired box from a carton or box folding and gluing machine without creating jams, which often occurred in the prior art devices.

Although various minor modifications may be suggested by those versed in the art, it should be understood that I wish to embody within the scope of the patent warranted hereon, all such modifications as reasonably and properly come within the scope of my contribution to the art.

I claim:

1. An apparatus for withdrawing a selected, folded box from a flow of folded boxes traveling in a plane of a device having means for conveying the folded boxes in said plane, said apparatus comprising means for detecting the selected box, means for selectively deflecting the selected box from the plane of the flow of folded boxes, said means for deflecting being disposed adjacent a discharge of the means for conveying, and including means for moving the deflecting means vertically with respect to the plane of the flow of folded boxes between a position withdrawn from the flow of folded boxes to a deflecting position in response to a signal from the means for detecting, and means for ensuring a positive conveyance of a selected box deflected from the plane of the flow, said means for ensuring the positive conveyance being disposed adjacent said discharge so that a box selected by the means for detecting is deflected from the plane of the flow of folded boxes and is positively conveyed away from said deflecting means and the flow of folded boxes.

2. An apparatus according to claim 1, wherein the means for moving comprises an air actuated piston having a piston rod and wherein said means for deflecting includes a blade disposed on said piston rod.

3. An apparatus according to claim 2, wherein said blade is slanted at an angle to the plane of the flow of folded boxes moving through the device.

4. An apparatus according to claim 2, wherein the blade is located obliquely on the end of said rod.

5. An apparatus for withdrawing a selected, folded box from a flow of folded boxes traveling in a plane of a device having means for conveying the folded boxes in said plane, said conveying means of the device includes a continuous belt conveyor, said apparatus comprising means for detecting the selected box, means for selectively deflecting the selected box from the plane of the flow of folded boxes, said means for deflecting being disposed adjacent a discharge of the means for conveying, and including means for moving the deflecting means relative to the plane of the flow of folded boxes between a position withdrawn from the flow of folded boxes to a deflecting position in response to a signal from the means for detecting, and means for ensuring a positive conveyance of a selected box deflected from the plane of the flow, said means for ensuring the positive conveyance being disposed adjacent said discharge and consisting of a belt conveyor adapted to coact with a portion of the return run of said continuous belt conveyor adjacent the discharge thereof, so that a box selected by the means for detecting is deflected from the plane of the flow of folded boxes and is positively conveyed away from said deflecting means and the flow of folded boxes.

6. An apparatus according to claim 5, wherein the means for moving moves the deflecting means vertically with respect to the plane of the flow of folded boxes.

7. An apparatus according to claim 6, wherein said continuous belt conveyor of the means for conveying folded boxes is an upper belt conveyor, and said belt conveyor of the means for ensuring positive conveyance acts jointly with an upper portion of said upper conveyor.

* * * * *